US012599961B2

(12) United States Patent
Kikugawa et al.

(10) Patent No.: US 12,599,961 B2
(45) Date of Patent: Apr. 14, 2026

(54) NOBLE METAL FINE PARTICLE AND USE THEREOF

(71) Applicant: NORITAKE CO., LIMITED, Nagoya (JP)

(72) Inventors: Yukiko Kikugawa, Nagoya (JP); Keiko Kato, Nagoya (JP); Yoshiki Watanabe, Nagoya (JP)

(73) Assignee: NORITAKE CO., LIMITED (JP)

( * ) Notice: Subject to any disclaimer, the term of this patent is extended or adjusted under 35 U.S.C. 154(b) by 898 days.

(21) Appl. No.: 17/797,460

(22) PCT Filed: Feb. 4, 2021

(86) PCT No.: PCT/JP2021/004049

§ 371 (c)(1),
(2) Date: Aug. 4, 2022

(87) PCT Pub. No.: WO2021/157641

PCT Pub. Date: Aug. 12, 2021

(65) Prior Publication Data

US 2023/0101983 A1 Mar. 30, 2023

(30) Foreign Application Priority Data

Feb. 5, 2020 (JP) ..... 2020-018028

(51) Int. Cl.
*B22F 1/00* (2022.01)
*B22F 1/054* (2022.01)
(Continued)

(52) U.S. Cl.
CPC ..... *B22F 1/00* (2013.01); *B22F 1/056* (2022.01); *B22F 1/14* (2022.01); *B22F 3/10* (2013.01); *B22F 2301/255* (2013.01)

(58) Field of Classification Search
CPC .... B22F 1/00; B22F 1/056; B22F 1/14; B22F 3/10; B22F 2301/255; B22F 1/102;
(Continued)

(56) References Cited

U.S. PATENT DOCUMENTS

2013/0168437 A1 7/2013 Miyairi et al.

FOREIGN PATENT DOCUMENTS

EP 3132872 A1 2/2017
JP 2001089139 A 4/2001
(Continued)

OTHER PUBLICATIONS

International Preliminary Report on Patentability issued in International Application No. PCT/JP2021/004049, dated Jul. 28, 2022.
(Continued)

*Primary Examiner* — Rebecca Janssen
(74) *Attorney, Agent, or Firm* — Taylor Duma LLP

(57) ABSTRACT

A noble metal fine particle herein disclosed includes a noble metal element as a main constituent metal element. An imine compound is held on a surface, and an amine/imine ratio (A/I ratio) of an area ratio of a peak area of the imine compound and a peak area of an amine compound determined in pyrolysis GCMS analysis with a pyrolysis temperature of 300° C. is 1 or less.

16 Claims, 8 Drawing Sheets

(51) Int. Cl.
*B22F 1/14* (2022.01)
*B22F 3/10* (2006.01)

(58) Field of Classification Search
CPC ..... B22F 1/16; C22C 1/0466; H01B 1/02; H01B 1/22; H01B 5/00; H01B 13/00
See application file for complete search history.

(56) References Cited

FOREIGN PATENT DOCUMENTS

| | | | | |
|---|---|---|---|---|
| JP | 2005330552 | A | | 12/2005 |
| JP | 2010209455 | A | * | 9/2010 |
| JP | 2013001954 | A | | 1/2013 |
| JP | 5613253 | B2 | | 10/2014 |
| JP | 2018003068 | A | | 1/2018 |
| JP | 2018154806 | A | | 10/2018 |
| TW | 201606890 | A | | 2/2016 |

OTHER PUBLICATIONS

Japan Office Action in JP 2021-575850, dated Aug. 7, 2024 (5 pages).
Chem. Mater. 2004, 16, 13, pp. 2509-2511.
International Search Report, Apr. 6, 2021 (3 Pages).
Japan Office Action in JP 2021-575850, dated Dec. 19, 2024 (3 pages).

* cited by examiner

NOBLE METAL FINE PARTICLE AND USE THEREOF

CROSS REFERENCE TO RELATED APPLICATIONS

This application is a U.S. national stage application of International Application no. PCT/JP2021/004049, filed Feb. 4, 2021, which claims the benefit of the filing date of Japanese Application No. 2020-018028, filed Feb. 5, 2020, the contents of which are hereby incorporated by reference in their entirety.

TECHNICAL FIELD

The present invention relates to a noble metal fine particle including a noble metal such as gold, platinum, or palladium. Further, the present invention relates to a powder material including such a noble metal fine particle, and a paste-shaped (slurry-shaped) dispersion including the noble metal fine particle dispersed in the medium.

BACKGROUND ART

In recent years, a noble metal fine particle and a material prepared in a paste (slurry) shape including the noble metal fine particle have been developed for various uses. For example, as a junction material for joining a semiconductor element, a so-called "solder" or "brazing filler metal" has been conventionally used. For junction using these, strict conditions such as temperatures as high as 300° C. or more and pressurization are imposed, undesirably resulting in damages on the to-be-joined member and element. For this reason, in place of using "solder" or "brazing filler metal", development of a low-temperature sintering type paste material using surface activation by particle refinement of a metal particle, and development of a paste material including a conductive material dispersed in a resin matrix have been performed (e.g., Patent Literature 1).

As low-temperature sinterable materials, a large number of paste materials mainly including a silver fine particle of nano size or submicron size have been developed. Further, in recent years, demand has also been increasing for a paste material mainly including a gold fine particle usable in environment requiring higher reliability. The fine particles including the noble metals have a high surface energy, and tend to agglomerate. For this reason, a study has been conducted on the way to prevent agglomeration between noble metal fine particles by using some compound (which is herein also referred to as a protective agent) on the surface of this kind of noble metal fine particle.

As one example, a technology adopting alkyl amine is known. Namely, it has been found that strong coordination of an amino group included in alkyl amine to a metal can disperse noble metal fine particles with stability. Dispersion of noble metal fine particles using alkyl amine as a protective agent has been reported. (e.g., Non Patent Literature 1, and Patent Literature 2).

CITATION LIST

Patent Literature

Patent Literature 1: Japanese Patent No. 5613253
Patent Literature 2: Japanese Patent Application Publication No. 2018-154806

Patent Literature 3: Japanese Patent Application Publication No. 2013-1954

Non Patent Literature

Non Patent Literature 1: Chem. Mater., Vol. 16 (No. 13), 2004, pp. 2509

SUMMARY OF INVENTION

However, the protective force by alkyl amine is proportional to the length and the deposition amount of the alkyl chain. For this reason, when the stability (dispersibility) by alkyl amine is enhanced, from the viewpoint of fully burning out the protective agent, the sintering temperature is forced to be relatively increased. The increasing of the sintering temperature goes against the development of a low-temperature sinterable fine particle material. Further, particularly for a gold fine particle out of noble metal fine particles, agglomeration/sedimentation are more likely to be caused as compared with a silver fine particle. For this reason, even when a long-chain alkyl amine is used, it is difficult to obtain a stable dispersion with a high concentration. For example, for a noble metal fine particle of Au, Ag, or the like disclosed in the Patent Literature 3, a mixed protective film of carboxylic acid and amine is put on the fine particle surface for avoiding agglomeration. However, removal of such a protective film requires sintering at relatively higher temperatures for a long time. Further, probably, due to the problem of agglomeration, an increase in concentration is not described, and the use thereof is limited.

Under such circumstances, the present invention was created in order to solve the problem regarding the noble metal fine particle as described above. It is an object of the present invention to provide a noble metal fine particle including a protective component capable of implementing high dispersion stability, and low-temperature sinterability capable of sintering at relatively lower temperatures. Further, It is another object of the present invention to provide a powder material, and a paste-shaped (slurry-shaped) dispersion including the noble metal fine particle. Furthermore, a method for manufacturing a noble metal sintered body using the noble metal fine particle herein disclosed is provided.

In order to implement the foregoing objects, the present invention provides a noble metal fine particle including a noble metal element as a main constituent metal element.

On the surface of the noble metal fine particle herein disclosed, an imine compound is held. Then, the present invention is characterized in that the amine/imine ratio (A/I ratio) of the area ratio of the peak area of the imine compound and the peak area of an amine compound (which includes the case of substantially 0) determined with pyrolysis Gas Chromatography-Mass Spectrometry (GCMS) analysis with a pyrolysis temperature of 300° C. is 1 or less.

Incidentally, in the present description and the appended claims, the term of "noble metal fine particle" means the particle aggregate (i.e., particles) of a large number of fine particles except for the case where the term denotes particularly one particle unit. For example, the noble metal fine particle in "a powder material or a dispersion including a noble metal fine particle" described later denotes a noble metal fine particle not as one particle but as particles (the particle aggregate). In Japanese, whether the word is singular or plural is ambiguous. For this reason, the "noble metal fine particle" is defined as described above in order to clarify the meaning thereof.

The present inventors completed the present invention based on the found described below. An imine compound generated by dehydration and condensation of a carbonyl compound (e.g., a carbonyl compound such as aldehyde resulting from oxidation of alcohol as a solvent) and a primary amine is held on the surface of a noble metal fine particle such as a gold fine particle so that the A/I ratio may become 1 or less (more preferably, the A/I ratio may become 0.6 or less), as a result, the noble metal fine particle has high dispersibility in various organic solvents. And by burning the noble metal fine particle at a burning temperature as low as 300° C. or less (e.g., about 250 to 300° C.), it is possible to obtain a dense noble metal sintered body.

A noble metal fine particle of a preferable aspect is characterized in that the DDLS/DSEM of the ratio of the Z average particle diameter (DDLS) based on the dynamic light scattering (DLS) method measured in a dispersed state in a prescribed medium, and the average particle diameter (DSEM) based on the field emission type scanning electron microscope image (FE-SEM image) is 2 or less.

The DDLS/DSEM can be said to be one of preferable indicators showing the degree of fixing of noble metal fine particles, in other words, the dispersibility. A noble metal fine particle characterized by such a DDLS/DSEM of 2 or less exhibits particularly favorable dispersibility, and hance can be favorably used for conductor formation use of a microscopic electrode, or the like, or as the raw material for a noble metal catalyst. Such DDLS/DSEM is more preferably 1.7 or less, and in particular preferably 1.5 or less.

A noble metal fine particle of a preferable aspect is characterized in that the Z average particle diameter (DDLS) is 200 nm or less.

Such a noble metal fine particle with a small particle diameter can be preferably used particularly for conductor formation use of a microscopic electrode, or the like, or as the raw material for a noble metal catalyst.

The DDLS is more preferably 150 nm or less, and in particular preferably, for example, 50 nm or more and 150 nm or less.

A noble metal fine particle of a preferable aspect is characterized in that, the imine compound is a compound expressed by the following structural formula:

$$R^0R^1C{=}N{-}(CH_2){-}R^2$$

where $R^0$ is hydrogen, and $R^1$ and $R^2$ are each a hydrocarbon group having 3 to 7 carbon atoms.

A noble metal fine particle holding such an imine compound having a hydrocarbon group having a relatively lower molecular weight, and being short (e.g., alkyl imine) on the surface can be readily eliminated by low-temperature burning of 300° C. or less. As a result, a dense sintered body can be manufactured with ease.

Further, a noble metal fine particle of one aspect herein disclosed is a gold fine particle including gold (Au) as the main constituent metal element.

Particularly, a gold fine particle out of noble metal fine particles tends to undergo agglomeration/sedimentation, and hence is preferable as an object to which the technology herein disclosed is applied.

The noble metal fine particle herein disclosed can be preferably used in various industrial fields. The noble metal fine particle can be preferably used especially for a conductor paste, a junction material (such as a power device, semiconductor packaging, or die bonding), a solder substitute, a plating substitute, a decoration, a reflective material, an antimicrobial agent, a catalyst, or the like. As the particularly preferable use, mention may be made of formation of an electrode of a microscopic electronic component (conductor).

Therefore, the present invention can provide a powder material including any noble metal fine particle herein disclosed, and a dispersion of a noble metal fine particle including the noble metal fine particle and a medium for dispersing the noble metal fine particle, for example, a conductor paste (a paste-shaped or slurry-shaped composition).

Further, the present invention provides a method for manufacturing a noble metal sintered body using any noble metal fine particle herein disclosed. By using the noble metal fine particle herein disclosed as a material, it is possible to manufacture a noble metal sintered body in a desirable form by a heat treatment (burning) at 300° C. or less.

A dispersion of a preferable aspect is characterized by including a cyclic alcohol having a hydroxy group on a cyclic chain as the disperse medium.

Inclusion of a cyclic alcohol as the disperse medium can implement particularly high dispersion stability. As a result of this, it is possible to prepare a higher-concentration dispersion (e.g., a conductor paste) with ease.

DESCRIPTION OF EMBODIMENTS

Figure 1:
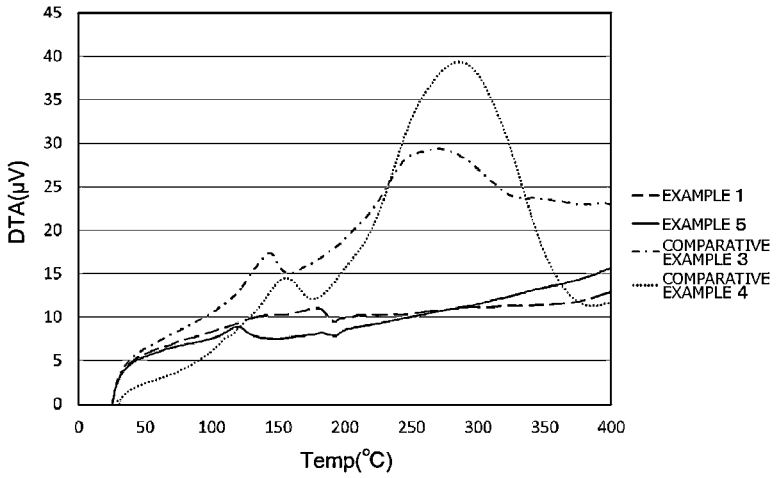
FIG. 1 is a graph showing the TG-DTA measurement results regarding some Examples and Comparative Examples.
Figure 2:
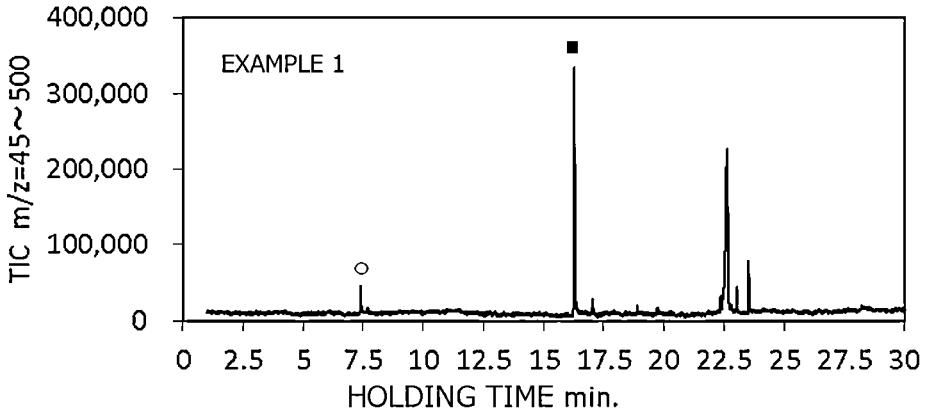
FIG. 2 is a pyrolysis GCMS spectrum obtained for Example 1.
Figure 3:
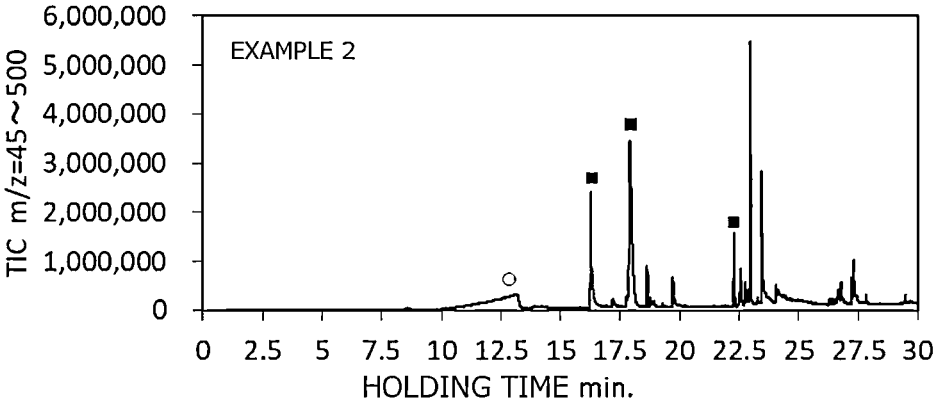
FIG. 3 is a pyrolysis GCMS spectrum obtained for Example 2.
Figure 4:
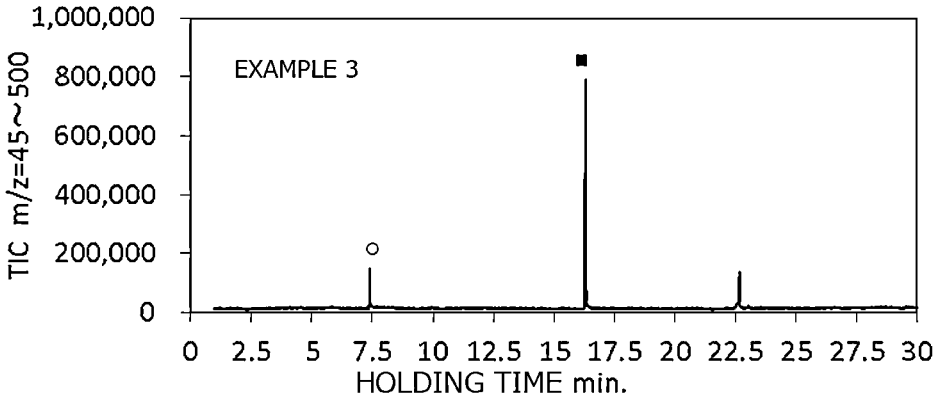
FIG. 4 is a pyrolysis GCMS spectrum obtained for Example 3.
Figure 5:
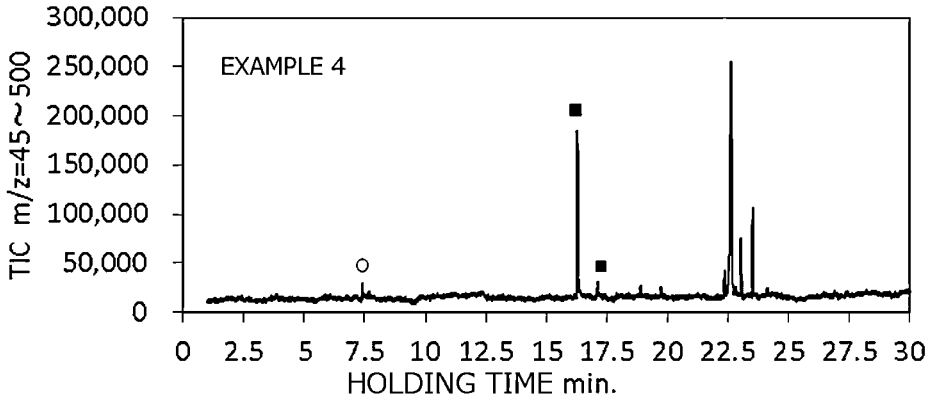
FIG. 5 is a pyrolysis GCMS spectrum obtained for Example 4.
Figure 6:
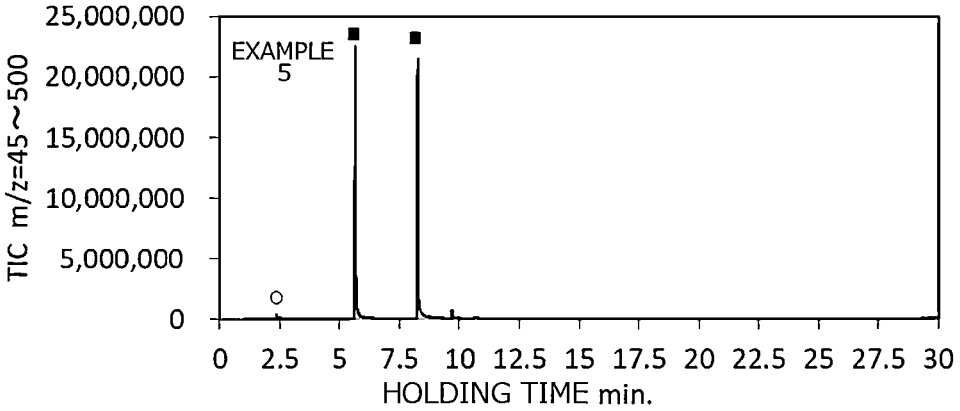
FIG. 6 is a pyrolysis GCMS spectrum obtained for Example 5.
Figure 7:
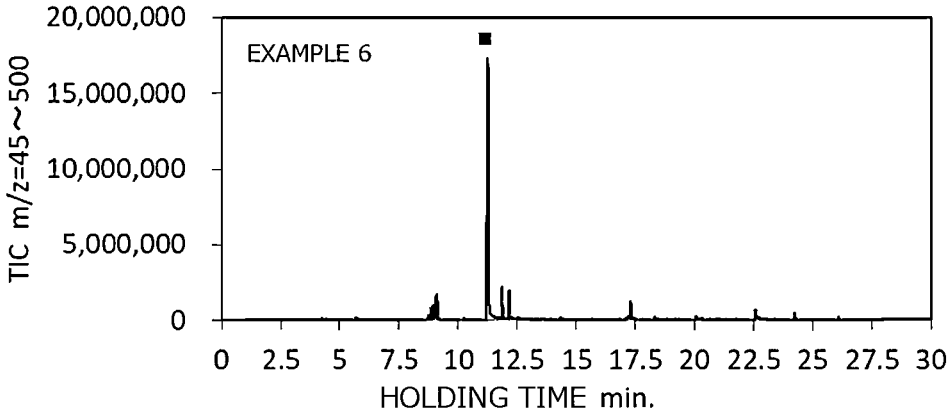
FIG. 7 is a pyrolysis GCMS spectrum obtained for Example 6.
Figure 8:
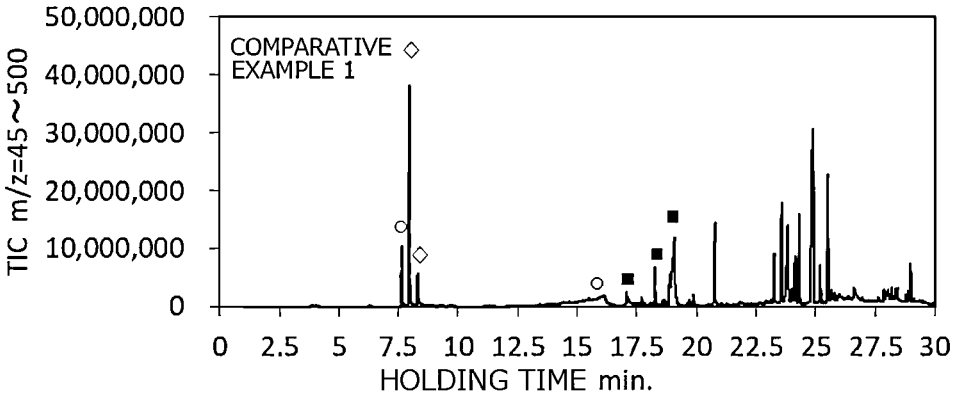
FIG. 8 is a pyrolysis GCMS spectrum obtained for Comparative Example 1.
Figure 9:
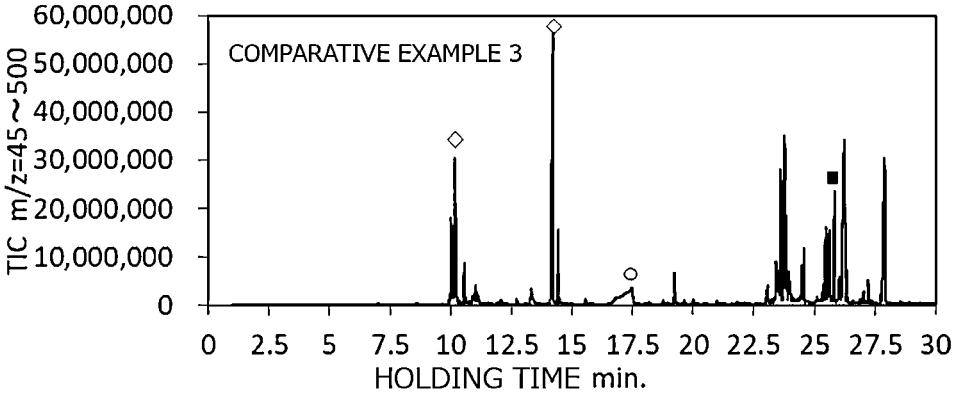
FIG. 9 is a pyrolysis GCMS spectrum obtained for Comparative Example 3.
Figure 10:
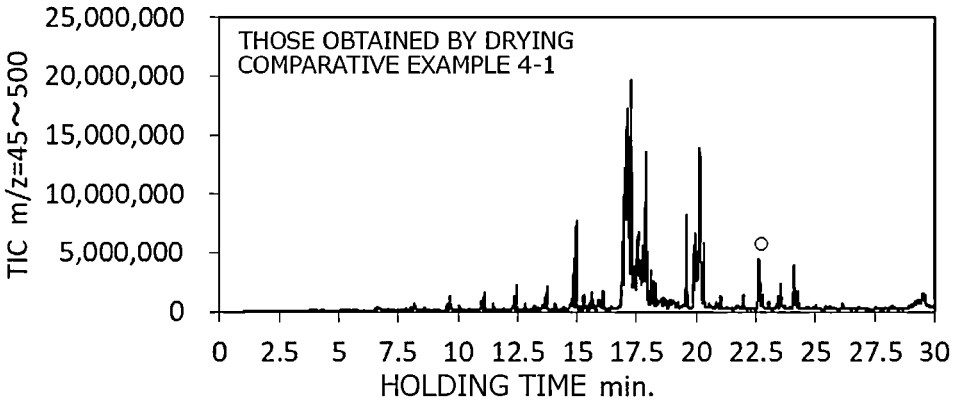
FIG. 10 is a pyrolysis GCMS spectrum obtained for Comparative Example 4 (the one obtained by drying the powder in the dispersion liquid of Comparative Example 4-1).
Figure 11:
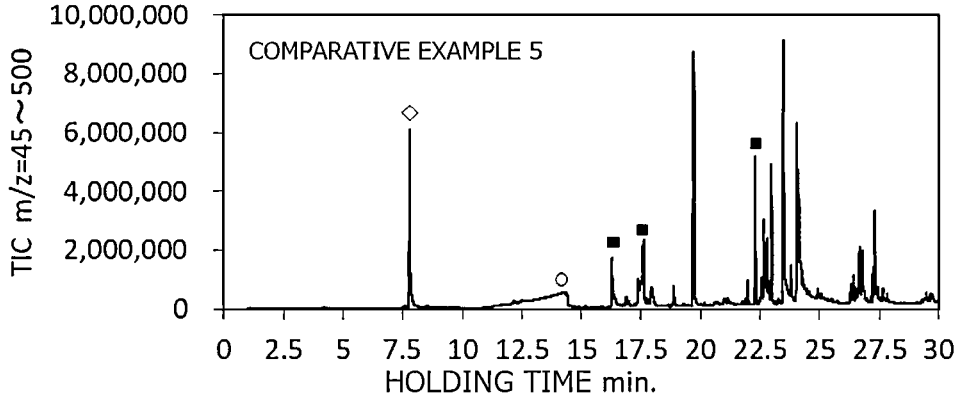
FIG. 11 is a pyrolysis GCMS spectrum obtained for Comparative Example 5.

Below, preferable embodiments of the present invention will be described. Incidentally, matters necessary for executing the present invention, except for matters specifically referred to in the present description can be grasped as design matters of those skilled in the art based on the related art in the present field. The present invention can be executed based on the contents disclosed in the present description, and the technical common sense in the present field.

Incidentally, in the present description and the appended claims, the term describing a prescribed numerical value range as A to B (where A and B are each a given numerical value) means A or more and B or less. Therefore, the term includes the case of more than A and less than B.

The noble metal fine particle herein disclosed is a noble metal fine particle including a noble metal element as the main constituent metal element, and has no restriction on the kind of the noble metal. Typically, mention may be made of gold (Au), silver (Ag), palladium (Pd), platinum (Pt), rhodium (Rh), or the like, or an alloy thereof. Herein, the main constituent metal element denotes a metal element serving as the main body forming the noble metal fine particle. The noble metal fine particle herein disclosed ideally includes only a noble metal element, and may be the one including various metal elements and non-metal elements as impurities. The organic matter content accounting for the total weight (100 wt %) of the noble metal fine particle (indicating the agglomerate before burning) measured based on TG-DTA is generally 2 wt % or less, further preferably 1.5 wt % or less, and in particular preferably 1 wt % or less.

On the surface of the noble metal fine particle herein disclosed, an imine compound is held as a protective agent.

Specifically, as with the reaction system described in Example later, a mixture of a noble metal salt or a noble metal complex soluble in a prescribed alcohol type solvent serving as the raw material for a noble metal fine particle (e.g., when the noble metal is gold, chloroauric acid ($HAuCl_4$), or the like may be mentioned.), an alkyl amine in a sufficient amount (e.g., 3 molar equivalents or more) relative to that of the noble metal, and an alcohol type solvent capable of dissolving the raw material therein, for example, alkyl alcohol is prepared. The mixture is heated to, for example, 80° C. or more. As a result of this, noble metal ions are reduced from the noble metal salt or complex, resulting in the formation of a noble metal fine particle.

The reduction treatment time of noble metal ions can be appropriately set. Although not particularly restricted, the reduction treatment time is preferably, for example, about 0.5 hour to 5 hours.

The recovery of the noble metal fine particle generated by the reduction treatment as described above may be the same as the conventional recovery of metal particles, and has no particular restriction. Preferably, the noble metal fine particle generated in a liquid is sedimented, and centrifuged, and the supernatant is removed. Preferably, washing and centrifugation are repeated plural times in an appropriate disperse medium, so that the noble metal fine particles are dispersed in the appropriate disperse medium. As a result, a desired noble metal fine particle dispersion can be obtained. Further, by adding a component such as a binder, it is possible to prepare a paste (slurry)-shaped composition (e.g., a conductor paste for forming an electrode film, or the like).

With the technology herein disclosed, in the generation process of the noble metal fine particle by the reduction treatment, an imine compound (typically an alkyl imine) is generated by dehydration condensation of a carbonyl compound and an alkyl amine (primary amine) derived from alcohol, and is held on the surface of the noble metal fine particle. Therefore, on the surface of the noble metal fine particle generated by the reaction system as described above, an organic matter which can also be regarded as the residue of alkyl amine, or the like which has not been involved in the generation of imine by the dehydration condensation other than the imine compound can be present.

Preferably, the abundance ratio of such an imine compound as to have an amine/imine ratio (A/I ratio) of the area ratio of the peak area of the imine compound, and the peak area of the amine compound (including the level not capable of detecting an amine compound, namely, the case of a peak area of 0) determined in the pyrolysis GCMS analysis with a pyrolysis temperature of 300° C. of 1 or less is preferably high. The generation ratio of such an imine compound as to have an A/I ratio of 0.6 or less (which can be, for example, 0.01 to 0.2) is in particular preferably high.

Preferably, the imine compound generated in the reaction system (some Examples described later will serve as reference.), and held on the surface of a noble metal fine particle is preferably the one with a relatively smaller molecular weight, specifically, an alkyl imine having a hydrocarbon group with about 10 or less carbon atoms, for example, 4 to 10 carbon atoms. An example thereof is a compound expressed by the structural formula: $R^0R^1C{=}N{-}(CH_2){-}R^2$.

$R^0$, $R^1$, and $R^2$ are each independently a partially substituted or non-substituted alkyl group, or hydrogen. Preferable examples thereof may include the one in which $R^0$ is hydrogen, and $R^1$ and $R^2$ are each a hydrocarbon group with 3 to 9 (more preferably 3 to 7) carbon atoms.

For example, specific preferable example thereof is the imine compound of the structural formula in which $R^0$ is hydrogen, and $R^1$ and $R^2$ are each $CH_3(CH_2)_6$, $CH_3(CH_2)_4$, or $CH_3\ (CH_2)_2$.

It becomes possible to selectively (preferentially) generate this kind of imine compound with a relatively low molecular weight, and a short chain length by selection of the alcohol solvent and the primary amine for use in the reaction system.

For example, when octanol ($CH_3(CH_2)_7OH$) is adopted as the alcohol solvent, and octyl amine ($CH_3(CH_2)_7NH_2$) is adopted as the primary amine, the resulting imine compound can have the structural formula in which $R^0$ is hydrogen, and $R^1$ and $R^2$ are each $CH_3(CH_2)_6$. Alternatively, in the reaction system, when the primary amine is substituted with butyl amine ($CH_3(CH_2)_3NH_2$), the resulting imine compound can have the structural formula in which $R^0$ is hydrogen, and at least one of $R^1$ and $R^2$ is $CH_3(CH_2)_2$. Still alternatively, in the reaction system, when the primary amine is substituted with hexyl amine ($CH_3(CH_2)_5NH_2$), the resulting imine compound can have the structural formula in which $R^0$ is hydrogen, and at least one of $R^1$ and $R^2$ is $CH_3(CH_2)_4$.

Thus, the proper selection of the alcohol solvent and the amine compound to be used in the reaction system can appropriately vary the molecular weight of the resulting imine compound (i.e., the composition of $R^0$, $R^1$, and $R^2$).

Incidentally, the structure of the resulting imine compound can be identified by measuring the pyrolysis GCMS spectrum as apparent from the description of Examples described later.

Regarding the particle size distribution of the noble metal fine particle herein disclosed, the DDLS/DSEM of the ratio of the Z average particle diameter (DDLS) based on the dynamic light scattering (DLS) method and the average particle diameter (DSEM) based on the field emission type scanning electron microscope image (FE-SEM image) is preferably 2 or less. The noble metal fine particle having such a characteristic has a property excellent particularly in dispersibility, and hence can contribute to miniaturization of an electronic component and thinning of an electrode in the electronic material field. Further, such a noble metal fine particle with a relatively small average particle diameter as to have a Z average particle diameter (DDLS) of 200 nm or less can further preferably advance thinning of an electrode, the improvement of the reliability, and the like.

By dispersing the noble metal fine particles herein disclosed in a disperse medium including an appropriate aqueous solvent or organic system solvent, it is possible to obtain a dispersion for various uses.

For example, the noble metal fine particles are dispersed in a prescribed organic solvent, and further, if required, components such as a binder, a conductive material, and a viscosity adjuster are added thereto. As a result, a composition (conductor paste) prepared in a paste shape can be provided. Such a conductor paste includes a noble metal fine particle with the Z average particle diameter controlled in a submicron region as described above. For this reason, it is possible to preferably form a sufficiently thinned electrode.

Incidentally, the disperse medium of the conductor paste may only can favorably disperse a conductive powder material therein as in related art, and those for use in conventional conductor paste preparation can be used without particular restriction. For example, as the organic solvents, petroleum type hydrocarbon such as Mineral spirit (particularly, aliphatic hydrocarbon), cellulose type polymer such as ethyl cellulose, high-boiling-point organic solvents such as ethylene glycol and diethylene glycol derivatives, toluene, xylene, butyl Carbitol (BC), and terpineol can be used singly alone, or in combination of a plurality thereof.

As a preferable disperse medium for preparing the dispersion herein disclosed, mention may be made of a cyclic alcohol having a hydroxy group on a cyclic chain. The inclusion of a cyclic alcohol as the disperse medium can implement high dispersion stability. Preferable examples thereof may include cyclic alcohols having 5-membered ring to 8-membered ring. Examples thereof may include terpineol, menthanol (dihydroterpineol), menthol (2-isopropyl-5-methyl cyclohexanol), cyclopentanol, cyclohexanol, and cycloheptanol. The cyclic alcohols may be used singly alone, or may be used in combination of two or more thereof. The content of the cyclic alcohol has no particular restriction, and is properly 10 to 100 mass %, and preferably 70 to 100 mass % based on the total amount of the disperse medium.

Below, as one example of the noble metal fine particle herein disclosed, Example regarding a gold (Au) fine particle including an imine compound held on the surface will be described. However, such Example is not intended to limit the present invention.

<1. Manufacturing Example of Gold Fine Particle>

Example 1

To 20.5 g of chloroauric acid tetrahydrate (product from Inuisho Precious Metals Co., Ltd.), 50 ml of octanol (product from FUJIFILM Wako Pure Chemical Industries, Ltd.) was added, and the resulting solution was cooled with stirring in an ice bath.

Then, n-octyl amine (product from FUJIFILM Wako Pure Chemical Industries, Ltd.) in an amount of 5 molar equivalents relative to the content of gold was gradually added to the solution while suppressing the heat generation, thereby preparing a complex forming solution of chloroauric acid-octyl amine.

A reduction treatment of heating the complex forming solution with stirring in a 140° C. oil bath in an air atmosphere for 3 hours was performed, thereby reducing gold ions, and synthesizing gold fine particles in accordance with the present Example.

Subsequently, the reaction solution was naturally cooled, and industrial alcohol (product from Amakasu Chemical Industries) was added thereto, thereby sedimenting gold fine particles, and the supernatant solution was removed by decantation. This operation was repeated three times, and then, industrial alcohol was added thereto. Centrifugation at 3000 rpm for 3 minutes was performed twice or more (herein three times), thereby removing the supernatant. Then, drying was performed at room temperature for 12 hours, resulting in a dried powder material including a noble metal fine particle in accordance with Example 1.

Example 2

A dried powder material including a noble metal fine particle in accordance with Example 2 was obtained with the same material and operation as those of Example 1, except that the amount of n-octyl amine was set at 10 molar equivalents relative to the content of gold.

Example 3

A dried powder material including a noble metal fine particle in accordance with Example 3 was obtained with the same material and operation as those of Example 1, except that the amount of n-octyl amine was set at 25 molar equivalents relative to the content of gold.

Example 4

A dried powder material including a noble metal fine particle in accordance with Example 4 was obtained with the same material and operation as those of Example 1, except that pure water was added in an amount of 50 molar equivalents relative to the content of gold to the complex forming solution of chloroauric acid-octyl amine of Example 1, and a heating reaction was effected.

Example 5

A dried powder material including a noble metal fine particle in accordance with Example 5 was obtained with the same material and operation as those of Example 2, except that n-butyl amine was used in place of n-octyl amine.

Example 6

A dried powder material including a noble metal fine particle in accordance with Example 5 was obtained with the same material and operation as those of Example 2, except that N-hexyl amine was used in place of N-octyl amine.

Comparative Example 1

Chloroauric acid tetrahydrate (product from Inuisho Precious Metals Co., Ltd.) was sealed in an amount of 20.5 g in a Schlenk tube, and was heated at 130° C. for 4 hours under the reduced pressure condition, thereby to be dehydrated. Then, the inside of the Schlenk tube was replaced with a nitrogen atmosphere. Then, n-octyl amine was added thereto in an amount of 10 molar equivalents relative to the content of gold. Then, a reduction treatment of performing heating at 100° C. for 3 hours while flowing nitrogen at a flow rate of 0.2 L/min was performed, thereby reducing gold ions, resulting in synthesis of a gold fine particle in accordance with the present Comparative Example.

Subsequently, the reaction solution was naturally cooled, and industrial alcohol (product from Amakasu Chemical Industries) was added thereto, thereby sedimenting gold fine particles. The supernatant solution was removed by decantation. After repeating this operation three times, industrial alcohol was added thereto, and centrifugation at 3000 rpm for 3 minutes was performed, thereby removing the supernatant. Then, drying was performed at room temperature for 12 hours, resulting in a dried powder material in accordance with Comparative Example 1.

Comparative Example 2

A dried powder material in accordance with Comparative Example 2 was obtained with the same material and operation as those of Example 1, except that the amount of n-octyl amine was set at 2 molar equivalents relative to the content of gold.

Comparative Example 3

A dried powder material in accordance with Comparative Example 3 was obtained with the same material and operation as those of Example 2, except that n-dodecyl amine was used in place of n-octyl amine.

Comparative Example 4

A dried powder material in accordance with Comparative Example 4 was obtained with the same material and operation as those of Example 2, except that oleyl amine was used in place of n-octyl amine.

Comparative Example 5

A dried powder material in accordance with Comparative Example 5 was obtained with the same material and operation as those of Example 2, except that the centrifugation was performed only one time.

<2. Manufacturing Example of Gold Fine Particle Dispersion Liquid>

Example 1-1

To the powder material in accordance with Example 1, menthanol of a cyclic alcohol was added as the disperse medium, and was allowed to stand still for 3 hours or more. Subsequently, solvent replacement was performed by performing centrifugation.

Menthanol was added to the resulting wet powder so that the weight of gold fine particles became 80 to 90 wt % based on the total amount, which was mixed and dispersed by a planetary centrifugal mixer, thereby preparing a dispersion liquid in accordance with Example 1-1.

Example 2-1

A dispersion liquid in accordance with Example 2-1 was prepared with the same material and operation as those of Example 1-1, except that a powder material in accordance with Example 2 was used.

Example 2-2

A dispersion liquid in accordance with Example 2-2 was prepared with the same material and operation as those of Example 2-1, except that menthanol/menthol (mass ratio 80/20) mixed alcohol was used as the disperse medium.

Example 2-3

A dispersion liquid in accordance with Example 2-3 was prepared with the same material and operation as those of Example 2-1, except that menthanol/menthol (mass ratio 50/50) mixed alcohol was used as the disperse medium.

Example 2-4

A dispersion liquid in accordance with Example 2-4 was prepared with the same material and operation as those of Example 2-1, except that menthanol/cyclopentanol (mass ratio 80/20) mixed alcohol was used as the disperse medium.

Example 2-5

A dispersion liquid in accordance with Example 2-5 was prepared with the same material and operation as those of Example 2-1, except that menthanol/cycloheptanol (mass ratio 80/20) mixed alcohol was used as the disperse medium.

Example 3-1

A dispersion liquid in accordance with Example 3-1 was prepared with the same material and operation as those of Example 1-1, except that the powder material in accordance with Example 3 was used.

Example 4-1

A dispersion liquid in accordance with Example 4-1 was prepared with the same material and operation as those of Example 1-1, except that the powder material in accordance with Example 4 was used.

Example 5-1

A dispersion liquid in accordance with Example 5-1 was prepared with the same material and operation as those of Example 1-1, except that the powder material in accordance with Example 5 was used.

Example 6-1

A dispersion liquid in accordance with Example 6-1 was prepared with the same material and operation as those of Example 1-1, except that the powder material in accordance with Example 6 was used.

Comparative Example 1-1

A dispersion liquid in accordance with Comparative Example 1-1 was prepared with the same material and operation as those of Example 2-2, except that the powder material in accordance with Comparative Example 1 was used.

Comparative Example 3-1

A dispersion liquid in accordance with Comparative Example 3-1 was prepared with the same material and operation as those of Example 2-2, except that the powder material in accordance with Comparative Example 3 was used.

Comparative Example 4-1

A dispersion liquid in accordance with Comparative Example 4-1 was prepared with the same material and operation as those of Example 2-2, except that the powder material in accordance with Comparative Example 4 was used.

Comparative Example 5-1

A dispersion liquid in accordance with Comparative Example 5-1 was prepared with the same material and operation as those of Example 1-1, except that the powder material in accordance with Comparative Example 5 was used.

<3. Evaluation Test>

(1) Characteristic of Gold Fine Particle

Using a field emission type scanning electron microscope (FE-SEM: product from Hitachi High-Tech Inc., S-4700), the gold fine particle in the powder material in accordance with each of Examples and Comparative Examples was observed (see FIGS. 16 to 25). Specifically, five images were randomly extracted from the visual field at a magnification of 100000 times or the visual field at a magnification of 50000 times. The particle diameters of every 40 independent particles were measured, thereby calculating the average particle diameter (DSEM) from the particle diameters of a total of 200 particles. The results are shown in the corresponding column of Table 1.

Further, for the powder material of each of Examples and Comparative Examples, using a ZETASIZER NANO ZS (product from Malvern Panalytical Co.), with N,N-dimethylformamide (DMF) as a disperse medium, a sample with a proper concentration was prepared by ultrasonic dispersion. DLS measurement was performed at 20° C., and the Z average particle diameter (DDLS) was calculated based on a general cumulant method. Herein, the one with a DDLS/DSEM of more than 2 was determined as an agglomerated one. The results are shown in the corresponding column of Table 1.

Further, for the powder material of each of Examples and Comparative Examples, using a thermogravimetry device (product from RIGAKU Corporation, TG-DTA/H), thermal analysis of the gold fine particle (dried powder material) was performed. Specifically, about 20 mg of the powder material in accordance with each of Examples and Comparative Examples was raised in temperature from room temperature to 400° C. at a rate of 10° C./min, and was held at 400° C. for 50 minutes. The heat behavior at this step was observed. The weight reduction rate at this step was referred to as the organic matter content accounting for the total weight (100 wt %) of the noble metal fine particle (dried powder). The results are shown in the corresponding column of Table 1. Further, the TG-DTA measurement results (graph) on Examples 1 and 5, and Comparative Example 3 and 4 are shown in FIG. 1.

TABLE 1

| | | Average particle diameter with FESEM (DSEM: nm) | Z average particle diameter with DLS (DDLS: nm) | DDLS/DSEM | Organic matter content (wt %) | Main component with pyrolysis GCMS at 300° C. | Presence or absence of exothermic peak at 200° C. or more with TG-DTA |
|---|---|---|---|---|---|---|---|
| Example | 1 | 95 | 129 | 1.36 | 0.79 | Imine compound A | None |
| | 2 | 39 | 57 | 1.46 | 0.61 | Imine compound A | None |
| | 3 | 50 | 67 | 1.34 | 0.90 | Imine compound A | None |
| | 4 | 68 | 110 | 1.62 | 0.58 | Imine compound A | None |
| | 5 | 59 | 94 | 1.59 | 0.80 | Imine compound B | None |
| | 6 | 89 | 117 | 1.31 | 0.77 | Imine compound C | None |
| Comparat ve | 1 | 26 | 81 | 3.12 | 1.55 | Complicated organic matter | Observed |
| Examp e | 2 | Particle not generated | — | — | — | — | — |
| | 3 | 21 | 104 | 4.95 | 2.34 | Complicated organ c natter | Observed |
| | 4 | 9 | 142 | 15.8 | 2.96 | Complicated organ c natter | Observed |
| | 5 | 37 | 133 | 3.59 | 1.28 | Complicated organ c natter | Observed |

As shown in Table 1, it could be confirmed that all the gold fine particles of the powder materials in accordance with respective Examples each had a DDLS/DSEM of 2 or less, and had favorable dispersibility. Further, in respective Examples, it could be confirmed that all the Z average particle diameters (DDLS) were 150 nm or less, and the samples were favorable powder materials contributing to miniaturization of an electronic component and thinning of an electrode.

Further, as shown in the corresponding column of Table 1 and FIG. 1, for the powder material in accordance with each Example, a large exothermic peak (derived from oxidation) at 200° C. or more observable for an alkyl amine particle was not detected in TG-DTA. This indicates as follows: the molecules of the organic matter present on the surface of the gold fine particle in accordance with each Example has been converted from alkyl amine to an imine compound (alkyl imine: see the structural formula) in the reaction system in which a gold fine particle is synthesized; and the amine added to the reaction system scarcely remains.

On the other hand, for the powder material in accordance with each Comparative Example, a large exothermic peak at 200° C. or more was detected in TG-DTA, which indicates that conversion from an alkyl amine to an imine compound has not been implemented well in the reaction system. For this reason, the dispersibility was also inferior, and the DDLS/DSEM was much larger than 2.

(2) Detection of Imine Compound

Using a pyrolysis GCMS device (product from SHIMADZU CORPORATION, GCMS-QP2010 Ultra), analysis of the gold fine particle dried powder material in accordance with each of Examples and Comparative Examples was performed.

Specifically, about 20 mg of the dried powder of a gold fine particle was heated at 300° C. for 18 seconds, thereby performing pyrolysis. The gas component generated from the sample was measured with GCMS. For the column, an Ultra ALLOY±5 (UA5-30M–0.25 F) manufactured by Frontier Laboratories Ltd., was used, and the column oven temperature was raised from 40° C. to 320° C. at a rate of 10° C./min, and was kept at 320° C. for 32 minutes. For the ionization method of the mass spectrometry device, an electron impact method (EI method) was used.

The pyrolysis GCMS spectra obtained for Examples 1, 2, 3, 4, 5, and 6 are shown in FIGS. 2, 3, 4, 5, 6, and 7, respectively. Further, the pyrolysis GCMS spectra obtained for Comparative Examples 1, 3, and 4 (only the ones obtained by drying the powder in the dispersion liquid of Comparative Example 4-1), and 5 are shown in FIGS. 8, 9, 10, and 11, respectively.

Figure 12:
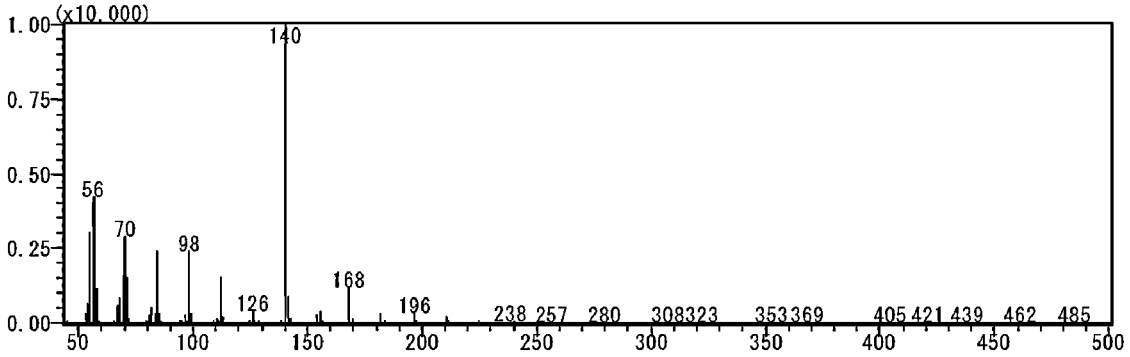
FIG. 12 is a MS spectrum of the peak (■) of each imine compound A detected in Examples 1 to 4 and Comparative Example 1.
Figure 13:
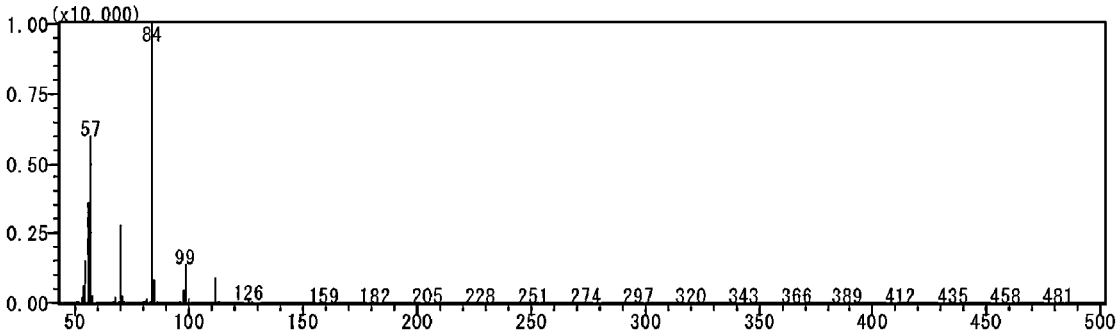
FIG. 13 is a MS spectrum of the peak (■) of an imine compound B detected in Example 5.
Figure 14:
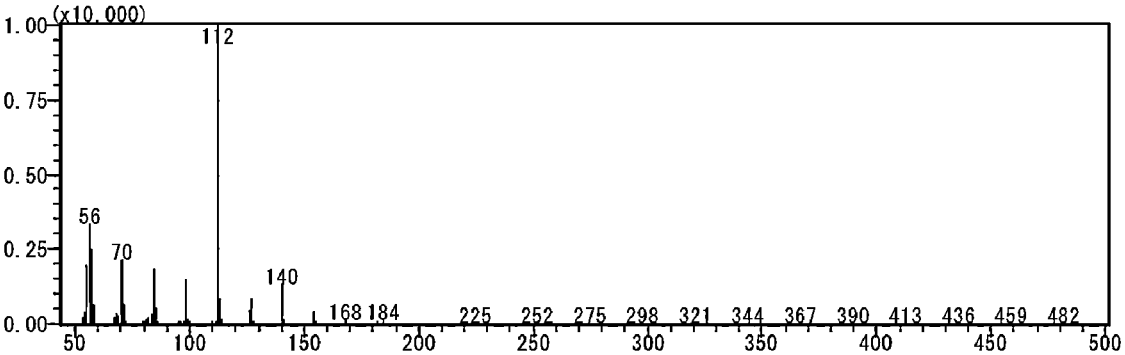
FIG. 14 is a MS spectrum of the peak (■) of an imine compound C detected in Example 6.

Furthermore, the MS spectrum of the peak (the peak ■ in the corresponding pyrolysis GCMS spectrum) of an imine compound A detected in each of Examples 1 to 4 and Comparative Example 1 is shown in FIG. 12. Further, the MS spectrum of the peak (the peak ■ in the corresponding pyrolysis GCMS spectrum) of an imine compound B detected in Example 5 is shown in FIG. 13. Still further, the MS spectrum of the peak (the peak ■ in the corresponding pyrolysis GCMS spectrum) of an imine compound C detected in Example 6 is shown in FIG. 14.

Figure 15:
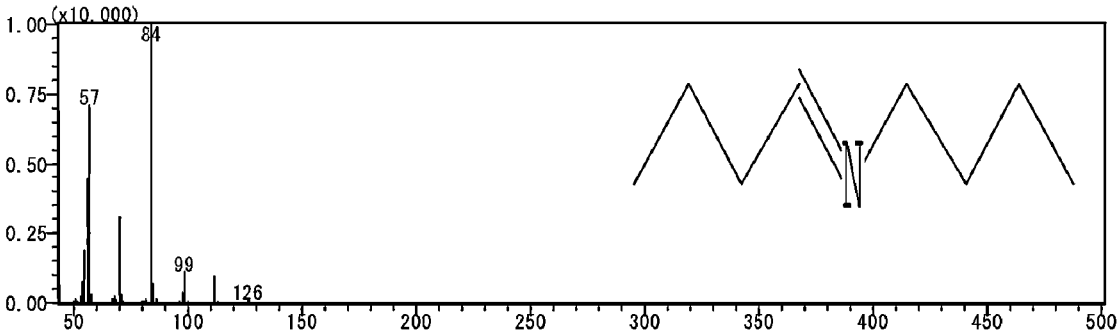
FIG. 15 is a MS spectrum (library data) of an imine compound B obtained by library search.
Figure 16:
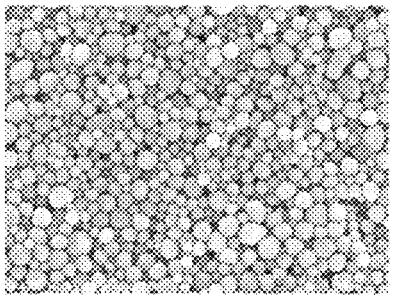
FIG. 16 is a FESEM observation image (a magnification of 50000 times) of a noble metal fine particle in accordance with Example 1.
Figure 17:
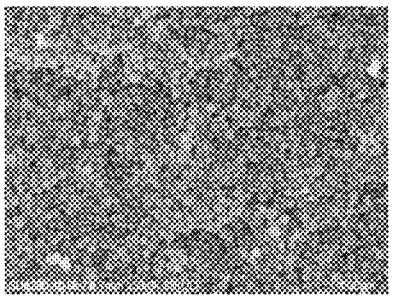
FIG. 17 is a FESEM observation image (a magnification of 50000 times) of a noble metal fine particle in accordance with Example 2.
Figure 18:
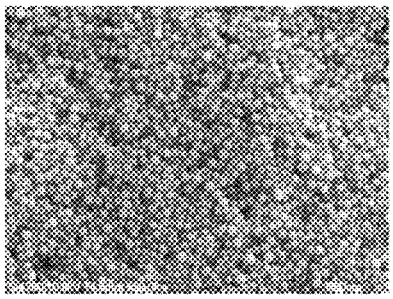
FIG. 18 is a FESEM observation image (a magnification of 50000 times) of a noble metal fine particle in accordance with Example 3.
Figure 19:
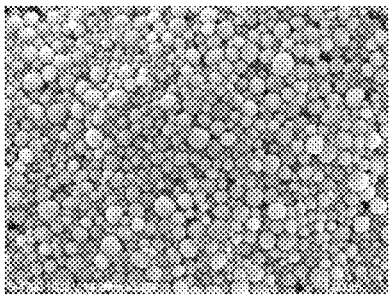
FIG. 19 is a FESEM observation image (a magnification of 50000 times) of a noble metal fine particle in accordance with Example 4.
Figure 20:
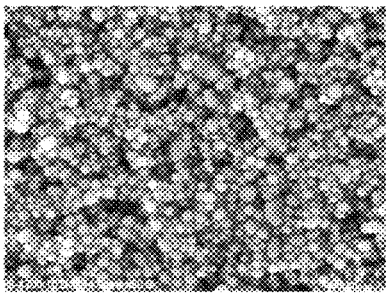
FIG. 20 is a FESEM observation image (a magnification of 50000 times) of a noble metal fine particle in accordance with Example 5.
Figure 21:
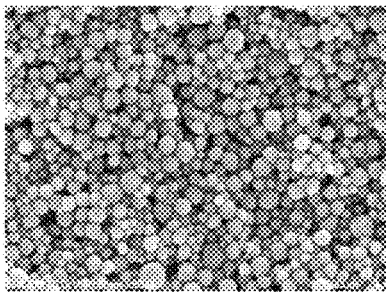
FIG. 21 is a FESEM observation image (a magnification of 50000 times) of a noble metal fine particle in accordance with Example 6.
Figure 22:
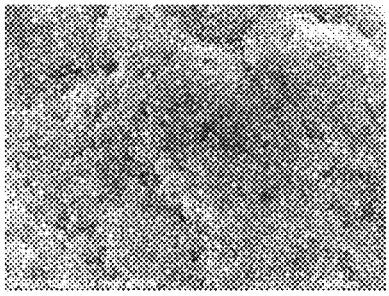
FIG. 22 is a FESEM observation image (a magnification of 50000 times) of a noble metal fine particle in accordance with Comparative Example 1.
Figure 23:
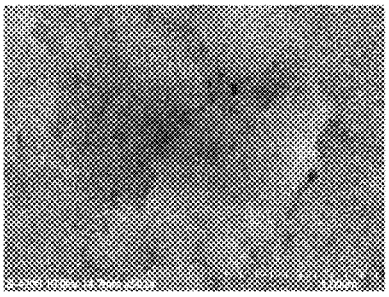
FIG. 23 is a FESEM observation image (a magnification of 50000 times) of a noble metal fine particle in accordance with Comparative Example 3.
Figure 24:
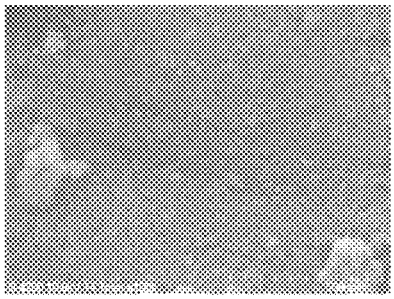
FIG. 24 is a FESEM observation image (a magnification of 50000 times) of a noble metal fine particle in accordance with Comparative Example 4.
Figure 25:
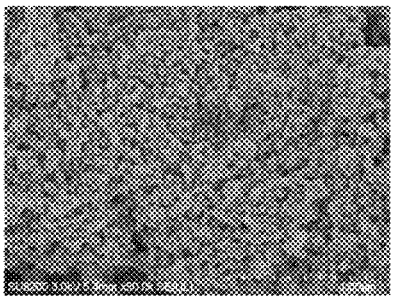
FIG. 25 is a FESEM observation image (a magnification of 50000 times) of a noble metal fine particle in accordance with Comparative Example 5.

Incidentally, the MS spectrum shown in FIG. 15 is the library data referred to for imputing the peak (■) of the imine compound B obtained by library search.

The identified imine compounds A, B, and C were as follows, respectively.

Imine Compound A

An imine compound expressed by the structural formula: $R^0R^1C{=}N{-}(CH_2){-}R^2$, where $R^0$ is hydrogen, and $R^1$ and $R^2$ are each $CH_3(CH_2)_6$.

Imine Compound B

An imine compound expressed by the structural formula: $R^0R^1C{=}N{-}(CH_2){-}R^2$, where $R^0$ is hydrogen, and $R^1$ and $R^2$ are each $CH_3(CH_2)_2$.

Imine Compound C

An imine compound expressed by the structural formula: $R^0R^1C{=}N{-}(CH_2){-}R^2$, where $R^0$ is hydrogen, and $R^1$ and $R^2$ are each $CH_3(CH_2)_4$.

The imine compounds A, B, and C were identified as described above according to the following analysis step.

Namely, for the peak (○) of amine observed in each spectrum and the peak (■) of the imine compound B observed in the spectrum of Example 5, library search of GCMS was carried out, thereby performing imputation (see FIG. 15).

On the other hand, for the imine compounds A and C, there was no data on the library. For this reason, imputation was performed based on the following consideration.

For respective MS spectra of the imine compounds A, B, and C (see FIGS. 12 to 14), the values considered derived from the fragments detected on the low molecular weight side such as 56 (57), 70, 84, 98 (99), and 112 scarcely vary from one another. From this, it is presumed that the imine compounds A, B, and C have the same skeleton. For this reason, it is indicated as follows: the possibility is very high that A and C also have an imine skeleton as with B of an imine compound.

Further, in the MS spectrum of the imine compound B, a molecular weight of 84 is most often detected. From this, it can be considered that the cleavage (fragmentation) at the position shown in the following structural formula is the main. Incidentally, the numerical value put in the structural formula corresponds to the molecular weight of fragment ions after cleavage.

[C1]

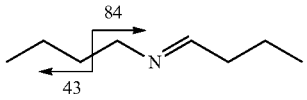

Therefore, it is presumed that, also for the compounds A and C considered to have the same skeleton, the cleavage at the same position is the main. Incidentally, in the MS spectrum of the compound B, it is determined that a molecular weight of 57, 70, 99, or the like is derived from the fragment peak at cleavage at a position other than the foregoing positions, and that 126 is derived from the molecular ion peak.

From the consideration up to this point, and the components present during synthesis, the structures of the compounds A and C were presumed. First, for the compound A, the structure was determined from the following: as shown in the following structural formula, a molecular weight of 140 derived from cleavage at the same position as that of the compound B is most often detected; and 168, 196, or the like considered to be the molecular weight at the fragment peak derived from cleavage at other positions is detected; and 238 considered to be the molecular weight of the molecular ion peak is detected.

[C2]

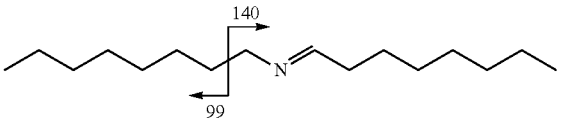

Then, for the compound C, the structure was determined from the following: as shown in the following structural formula, a molecular weight of 112 derived from cleavage at the same position as that of the compound B is most often detected; and 140, 168, or the like considered to be the molecular weight of the fragment peak derived from cleavage at other positions is detected; and 184 considered to be the molecular weight of the molecular ion peak is detected.

[C3]

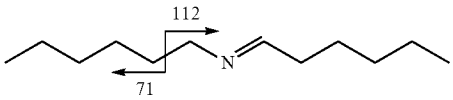

As shown in the corresponding column of Table 1, it has been observed that in every Example, a desirable imine compound (herein, alkyl imine) is generated on the surface of the gold fine particle. Further, as apparent from the pyrolysis GCMS spectrum of each Example, it is observed that the amount of the imine compound generated is larger than the residual amount of the amine compound (see A/I ratio described later).

On the other hand, for each Comparative Example, the number of miscellaneous peaks derived from oxidative decomposition was large, and the amount of the imine compound generated was very small, or only at the level where it could be said that the compound was not generated. Incidentally, for Comparative Example 2, the synthesis itself of the gold fine particle did not work well.

Then, the area value of each peak was calculated using analysis software from the spectrum of the pyrolysis GCMS. Then, the amine/imine ratio (A/I ratio) was determined from respective area values of the imine compound and the amine compound (the total value of respective peak areas for the one with a plurality of peaks). The results are shown in Table 2.

TABLE 2

| sample | Imine (I) Total area | Amine (A) Total area | A/I ratio |
|---|---|---|---|
| Example 1 | 717162 | 126898 | 0.18 |
| Example 2 | 39717546 | 22478366 | 0.57 |
| Example 3 | 1923018 | 352175 | 0.18 |
| Example 4 | 403198 | 37723 | 0.09 |
| Example 5 | 110831321 | 1029442 | 0.01 |
| Example 6 | 69424409 | — | 0.00 |
| Comparative Example 1 | 47194042 | 128533614 | 2.72 |
| Comparative Example 3 | 60929706 | 101077919 | 1.66 |

TABLE 2-continued

| sample | Imine (I) Total area | Amine (A) Total area | A/I ratio |
|---|---|---|---|
| Comparative Example 4 | Decomposed product is complicated. and cannot be imputed | | |
| Comparative Example 5 | 20981761 | 44573888 | 2.12 |

As shown in Table 2, for the gold fine particles (powders) in accordance with respective Examples, all the A/I ratios were 1 or less (specifically, 0.6 or less), and it was observed that conversion from the amine compound to the imine compound was performed with high efficiency. On the other hand, for respective Comparative Examples, the number of miscellaneous decomposed products derived from oxidative decomposition was large, and all the A/I ratios were also more than 1.

(3) Performance Evaluation of Gold Fine Particle Dispersion Liquid

First, for the paste-shaped dispersion liquids in accordance with respective Examples and Comparative Examples herein used, those with rough surfaces, and mat appearances, and those indepositable due to separation of the liquid and the particles were indicated with CC, and those without rough surfaces, and with metal gloss were indicated with AA for evaluation. AA and CC are shown in the corresponding column of Table 3. Namely, all the paste-shaped dispersion liquids in accordance with respective Examples were evaluated as AA. All the paste-shaped dispersion liquids in accordance with respective Comparative Examples were evaluated as CC.

With the dispersion liquid in accordance with each of Examples and Comparative Example as a material, a burnt film was formed, thereby performing performance evaluation.

As described above, the paste-shaped dispersion liquid of each of Examples and Comparative Examples prepared so that the weight of the gold fine particle became 80 to 90 wt % based on the total amount was applied to a glass substrate. Specifically, the dispersion liquid applied on a 1 cm×1 cm×100 μm metal mask was squeezed by a rubber squeegee, thereby coating each dispersion liquid in a prescribed shape. Thereafter, the resulting dispersion liquid was dried at 60° C. for 1 hour, and then, was subjected to a burning treatment at 250° C. or 300° C. for 30 minutes, thereby forming a burnt film (gold film) in a prescribed shape.

For the resulting burnt film, using a Loresta GP (Mitsubishi Chemical Analytech Co., Ltd., product MCP-T610) of a commercially available resistivity meter, the sheet resistance value was measured. Further, the measurement of the film thickness was carried out using a thickness measurement meter (TESTER SANGYO CO., LTD., product TH-102). The volume resistivity was calculated as the product of the resulting sheet resistance value and film thickness. The results are shown in Table 3.

Further, the ion milling polished surface was observed by FESEM. Specifically, the area of the black void part was determined by image analysis software "Image Pro" manufactured by Media Cybernetics Co., from the FESEM observation image at a magnification of 10000 times (see FIGS. 16 to 25), and was calculated as the denseness (%)=1−(area of void/total area) %. The results are shown in the corresponding column of Table 3.

TABLE 3

| | Disperse medium | Dispersibility/depositability | Denseness of burnt film (%) | | Volume resistivity of burnt film (μ Ω · cm). | |
|---|---|---|---|---|---|---|
| | | | 250° C. 30 minutes | 300° C. 30 minutes | 250° C. 30 minutes | 300° C. 30 minutes |
| Example | 1-1 Menthanol | ○ | 94.1 | 98.1 | 3.7 | 3.0 |
| | 2-1 Menthanol | ○ | 90.5 | 99.2 | 7.0 | 3.2 |
| | 2-2 Menthanol/menthol (80/20) | ○ | 88.7 | 98.7 | 3.3 | 5.2 |
| | 2-3 Menthanol/menthol (50/50) | ○ | 96.8 | 98.4 | 5.7 | 4.8 |
| | 2-4 Menthanol/cyclopentanol (80/20) | ○ | 91.0 | 99.7 | 6.3 | 2.8 |
| | 2-5 Menthanol/cyclopentanol (80/20) | ○ | 94.4 | 96.1 | 5.4 | 3.1 |
| | 3-1 Menthanol | ○ | 98.9 | 98.9 | 3.1 | 2.9 |
| | 4-1 Menthanol | ○ | 98.3 | 98.9 | 3.3 | 2.8 |
| | 5-1 Menthanol | ○ | 78.4 | 90.2 | 7.4 | 3.4 |
| | 6-1 Menthanol | ○ | 78.9 | 98.8 | 7.0 | 3.0 |
| Comparative Example | 1-1 Menthanol/menthol (80/20) | x | Indepositable | | | |
| | 3-1 Menthanol/menthol (80/20) | x | Unmeasurable due to burnt film cracking | | | |
| | 4-1 Menthanol/menthol (80/20) | x | Unmeasurable due to burnt film cracking | | | |
| | 5-1 Menthanol | x | Unmeasurable due to burnt film cracking | | | |

As apparent from the results shown in Table 3, it could be confirmed as follows: the burnt film (film-shaped noble metal sintered body) including the gold fine particle of each Example having an imine compound with a preferable A/I ratio (see Table 2) on the surface has a high denseness; as a result, a conductor film having a low volume resistivity, and a favorable conductivity can be formed. Further, it could also be confirmed that a favorable burnt film can be obtained at a heat treatment temperature as low as 250 to 300° C.

Thus, with the noble metal fine particle herein disclosed, it is possible to provide a powder material capable of implementing high dispersion stability and low-temperature sinterability sinterable at a relatively low temperature. Further, the noble metal sintered body (in the present example, the burnt film) with a high conductivity can be obtained. For this reason, a paste-shaped (slurry-shaped) dispersion mainly including the noble metal fine particle herein disclosed can be used for various uses.

The invention claimed is:

1. A noble metal fine particle comprising a noble metal element as a main constituent metal element, wherein an imine compound is held on a surface of a particle, and an amine/imine ratio (A/I ratio) of an area ratio of a peak area of the imine compound and a peak area of an amine compound (including a case of substantially 0) determined in pyrolysis Gas Chromatography-Mass Spectrometry (GCMS) analysis with a pyrolysis temperature of 300° C. is 1 or less, wherein the imine compound is a compound expressed by the following structural formula:

$R^0R^1C{=}N{-}(CH_2){-}R^2$ where $R^0$ is hydrogen, and $R^1$ and $R^2$ are each a hydrocarbon group with 3 to 7 carbon atoms.

2. The noble metal fine particle according to claim 1, wherein the A/I ratio is 0.6 or less.

3. The noble metal fine particle according to claim 1, wherein DDLS/DSEM of a ratio of a Z average particle diameter (DDLS) based on a dynamic light scattering (DLS) method measured in a state dispersed in a prescribed medium, and an average particle diameter (DSEM) based on a field emission type scanning electron microscope image (FE-SEM image) is 2 or less.

4. The noble metal fine particle according to claim 1, wherein the Z average particle diameter (DDLS) based on the dynamic light scattering (DLS) method measured in a state dispersed in a prescribed medium is 200 nm or less.

5. The noble metal fine particle according to claim 1, wherein the main constituent metal element is gold (Au).

6. A powder material comprising the noble metal fine particle according to claim 1.

7. A dispersion of a noble metal fine particle, comprising: the noble metal fine particle according to claim 1; and a medium for dispersing the noble metal fine particle.

8. The dispersion according to claim 7, comprising a cyclic alcohol having a hydroxy group on a cyclic chain as the disperse medium.

9. A method for manufacturing a noble metal sintered body, comprising sintering a noble metal sintered body comprising the noble metal fine particle according to claim 1.

10. The manufacturing method according to claim 9, wherein the noble metal fine particle is subjected to a heat treatment at 300° C. or less.

11. The noble metal fine particle according to claim 2, wherein DDLS/DSEM of a ratio of a Z average particle diameter (DDLS) based on a dynamic light scattering (DLS) method measured in a state dispersed in a prescribed medium, and an average particle diameter (DSEM) based on a field emission type scanning electron microscope image (FE-SEM image) is 2 or less.

12. The noble metal fine particle according to claim 2, wherein the Z average particle diameter (DDLS) based on the dynamic light scattering (DLS) method measured in a state dispersed in a prescribed medium is 200 nm or less.

13. The noble metal fine particle according to claim 3, wherein the Z average particle diameter (DDLS) based on the dynamic light scattering (DLS) method measured in a state dispersed in a prescribed medium is 200 nm or less.

14. The noble metal fine particle according to claim 2, wherein the main constituent metal element is gold (Au).

15. The noble metal fine particle according to claim 3, wherein the main constituent metal element is gold (Au).

16. The noble metal fine particle according to claim 4, wherein the main constituent metal element is gold (Au).

* * * * *